US006550875B1

(12) United States Patent
Compton et al.

(10) Patent No.: US 6,550,875 B1
(45) Date of Patent: Apr. 22, 2003

(54) STORAGE CABINET REMOVABLY MOUNTED ON A WORKSURFACE BY SUPPORT STANCHIONS

(75) Inventors: Cheryl C. Compton, Grand Haven, MI (US); Daniel C. K. West, Grand Rapids, MI (US); Ricky D. Roels, Holland, MI (US); Charles J. Saylor, Grand Rapids, MI (US); Robert Clare Wayner, Holland, MI (US); Mark Powell, Grand Haven, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/561,397

(22) Filed: Apr. 28, 2000

(51) Int. Cl.[7] ..... A47B 17/00
(52) U.S. Cl. ..... 312/196; 108/92; 248/231.71
(58) Field of Search ..... 312/194, 196, 312/198; 108/50.01, 50.02, 92, 93, 97, 98, 150; 248/227.2, 228.6, 229.25, 231.71, 235, 250

(56) References Cited

U.S. PATENT DOCUMENTS

| | | | | |
|---|---|---|---|---|
| 401,553 A | | 4/1889 | Godfrey | |
| 646,835 A | * | 4/1900 | Jackson | 248/231.71 X |
| 690,932 A | * | 1/1902 | Dawe | 108/97 |
| 956,705 A | * | 5/1910 | Hofacker | 108/97 |
| 1,039,554 A | | 9/1912 | Lindhorst | |
| 1,522,079 A | * | 1/1925 | Read | 248/231.71 X |
| 1,645,470 A | * | 10/1927 | Alheit | 248/231.71 X |
| 1,763,306 A | * | 6/1930 | Hendrickson | 312/198 X |
| 1,798,809 A | * | 3/1931 | Randall | 248/231.71 X |
| 1,830,347 A | | 11/1931 | Camden et al. | |
| 2,551,157 A | | 5/1951 | Price | |
| 2,608,777 A | | 9/1952 | Schuler | |
| 2,628,051 A | * | 2/1953 | Anderson | 248/231.71 X |
| 2,979,155 A | | 4/1961 | Scharfenberger | |
| 3,744,645 A | | 7/1973 | Hochman | |

(List continued on next page.)

FOREIGN PATENT DOCUMENTS

| | | | | |
|---|---|---|---|---|
| CH | 680414 A5 | | 8/1992 | |
| DE | 8 629 967 | | 2/1987 | |
| EP | 413904 | * | 2/1991 | 312/196 |
| JP | 04005910 | * | 1/1992 | 312/196 |

OTHER PUBLICATIONS

Three (3) photographs of Arrio cabinets by Herman Miller, Inc. publication date unknown.

Drawings from U.S. Ser. No. 09/304,162, filed Apr. 30, 1999.

Drawings from U.S. Ser. No. 09/579,092, filed on May 25, 2000.

Herman Miller "Arrio Freestanding Systems Furniture" Pricebook, Oct. 1, 1996, pp. 122 and 124–125.

*Primary Examiner*—Lanna Mai
*Assistant Examiner*—Hanh V. Tran
(74) *Attorney, Agent, or Firm*—Flynn, Thiel, Boutell & Tanis, P.C.

(57) ABSTRACT

A storage cabinet assembly which is mounted on a worksurface by one or more support stanchions which project generally upwardly from the worksurface adjacent an edge thereof. The support stanchions position the storage cabinet in upwardly spaced relation from an upper surface of the worksurface and so that the rear side of the cabinet is generally vertically aligned with the edge of the worksurface. The storage cabinet includes one or more horizontal shelves which are adapted to mount upright divider elements thereon which define upwardly and sidewardly opening channels for accommodating documents or other materials therein.

16 Claims, 6 Drawing Sheets

U.S. PATENT DOCUMENTS

| | | | | | |
|---|---|---|---|---|---|
| 3,949,880 | A | | 4/1976 | Fortunato | |
| 4,126,230 | A | | 11/1978 | Tyson et al. | |
| 4,160,570 | A | | 7/1979 | Bridges | |
| 4,190,002 | A | | 2/1980 | Redemann | |
| 4,300,692 | A | | 11/1981 | Moreno | |
| 4,317,416 | A | | 3/1982 | Baum et al. | |
| 4,323,291 | A | | 4/1982 | Ball | |
| 4,373,639 | A | | 2/1983 | Tricon | |
| 4,503,981 | A | | 3/1985 | Coronado | |
| 4,510,872 | A | | 4/1985 | Parry | |
| 4,687,166 | A | * | 8/1987 | Poehler | 312/196 X |
| 4,709,891 | A | | 12/1987 | Barnett | |
| 4,852,500 | A | | 8/1989 | Ryburg et al. | |
| 4,869,378 | A | | 9/1989 | Miller | |
| 4,879,955 | A | | 11/1989 | Moll et al. | |
| 4,884,513 | A | | 12/1989 | Newhouse et al. | |
| 4,899,971 | A | | 2/1990 | Elkin | |
| 4,914,873 | A | | 4/1990 | Newhouse | |
| 4,938,442 | A | | 7/1990 | Mastrodicasa | |
| 4,948,205 | A | | 8/1990 | Kelley | |
| 4,974,913 | A | | 12/1990 | Vogt et al. | |
| 4,993,785 | A | | 2/1991 | Dunand | |
| 5,048,698 | A | | 9/1991 | Konrad | |
| 5,057,039 | A | | 10/1991 | Persing et al. | |
| 5,092,253 | A | | 3/1992 | Grund et al. | |
| 5,096,273 | A | * | 3/1992 | Alexander et al. | 312/198 |
| 5,103,741 | A | | 4/1992 | Grund et al. | |
| 5,106,173 | A | | 4/1992 | Kelley et al. | |
| 5,121,698 | A | | 6/1992 | Kelley | |
| 5,152,698 | A | | 10/1992 | Juhlin et al. | |
| 5,154,126 | A | | 10/1992 | Newhouse et al. | |
| 5,160,188 | A | | 11/1992 | Rorke et al. | |
| D333,489 | S | | 2/1993 | Stern et al. | |
| 5,183,319 | A | | 2/1993 | Pearson et al. | |
| 5,226,705 | A | | 7/1993 | Rorke et al. | |
| 5,282,427 | A | * | 2/1994 | Steinhilber | 108/97 |
| 5,429,252 | A | | 7/1995 | Liu | |
| 5,486,042 | A | | 1/1996 | Heisler et al. | |
| 5,775,521 | A | | 7/1998 | Tisbo | |
| 5,873,311 | A | | 2/1999 | Schlattl | |
| 5,906,420 | A | | 5/1999 | Rozier, Jr. et al. | |
| 5,931,102 | A | | 8/1999 | Grahl | |
| 5,937,766 | A | | 8/1999 | Denny | |
| 5,971,171 | A | * | 10/1999 | Thorp et al. | 108/92 X |
| 6,152,312 | A | | 11/2000 | Nava et al. | |

* cited by examiner 161A
162A
171A
32
31
60
30
21
73
31
34
36
33
35
40
35
70
161A
24
74
72A
61
183
179
61
180B
180B
72
40
30
22
34
36
73
35
20
33
56
54
35
160
108
60
100
113
15
114
146
9
130
141
10
102
142
131
11
12
9
132
14
13
137
116
136
133
135

STORAGE CABINET REMOVABLY MOUNTED ON A WORKSURFACE BY SUPPORT STANCHIONS

FIELD OF THE INVENTION

This invention relates to a storage cabinet for mounting adjacent the edge of a worksurface such as a table, which storage cabinet is adapted to mount thereon a plurality of divider elements for storage and organization of documents.

BACKGROUND OF THE INVENTION

The modern office environment has ever increasing demands with respect not only to the availability of effective work space particularly in association with a worksurface, but also the efficient or effective utilization of space around a worksurface. The demands and space requirements for computers and telecommunication equipment, as well as the demands for various office tools or accessories which are typically supported on top of a worksurface, generally result in excessive clutter on the worksurface thus limiting the available work space. In an effort to increase the available work space, attempts have been made to position many of the accessories on an adjacent wall. This alternative not only renders the wall structure more complex, but is not available in those situations where the worksurface is not disposed adjacent a wall. As a further alternative, some worksurfaces or tabletops are provided with upright structures secured along the rear edge of the worksurface which project upwardly so as to provide additional storage compartments and the like, although even this alternative greatly increases the overall complexity of the worksurface arrangement and in particular significantly interferes with openness and visibility around the worksurface.

In recognition of the disadvantages associated with conventional structures of the type briefly summarized above, the present invention relates to a shelf arrangement supportable on a worksurface or other horizontal surface. The arrangement includes a generally horizontally oriented shelf which is adapted to removably mount thereon divider elements for separating and storing documents or other work-related items. The shelf is supported over the worksurface by one or more upright support arms or stanchions which are removably mounted adjacent an edge of the worksurface and which support the shelf in vertically spaced relation relative to the worksurface.

The present invention also relates to a storage cabinet which is mountable in raised relation with a worksurface by a pair of support arms or stanchions. In one embodiment, the storage cabinet defines an enclosable interior storage area which is accessible through a pair of doors which define the front face of the cabinet. The cabinet is defined by generally horizontal upper and lower walls or shelves which are vertically spaced from one another by a pair of upright side walls and a rear wall which defines the rear face of the cabinet.

The desirable structural and functional features of the present invention, as well as other operational advantages thereof, will be apparent upon reading the following specification and inspecting the accompanying drawings.

Figure 1:
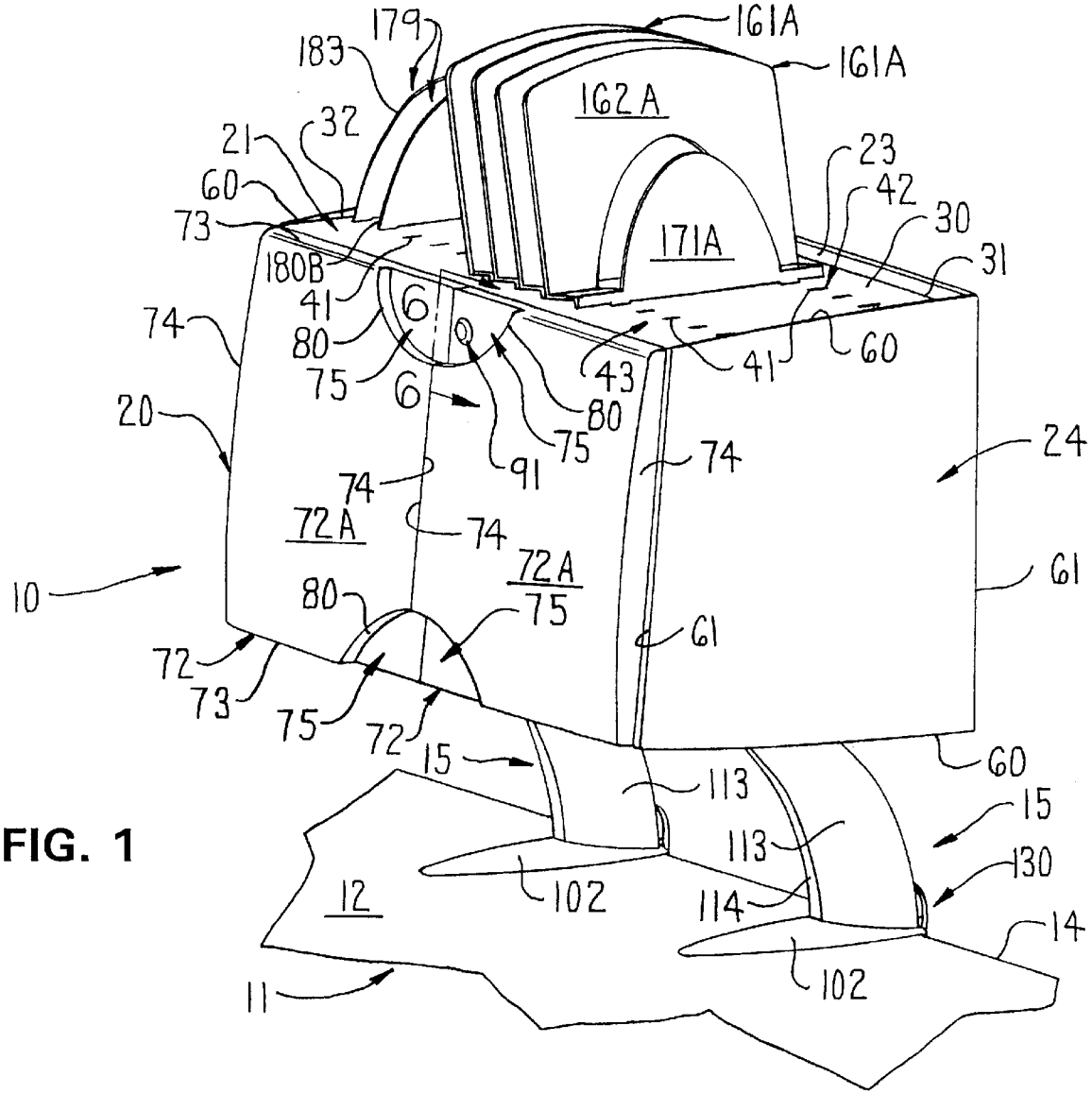
FIG. 1 is a perspective view which illustrates a fragment of a horizontally enlarged worksurface having a storage cabinet according to the invention mounted adjacent one thereof.

Certain terminology will be used in the following description for convenience in reference only, and will not be limiting. For example, the words "upwardly" and "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
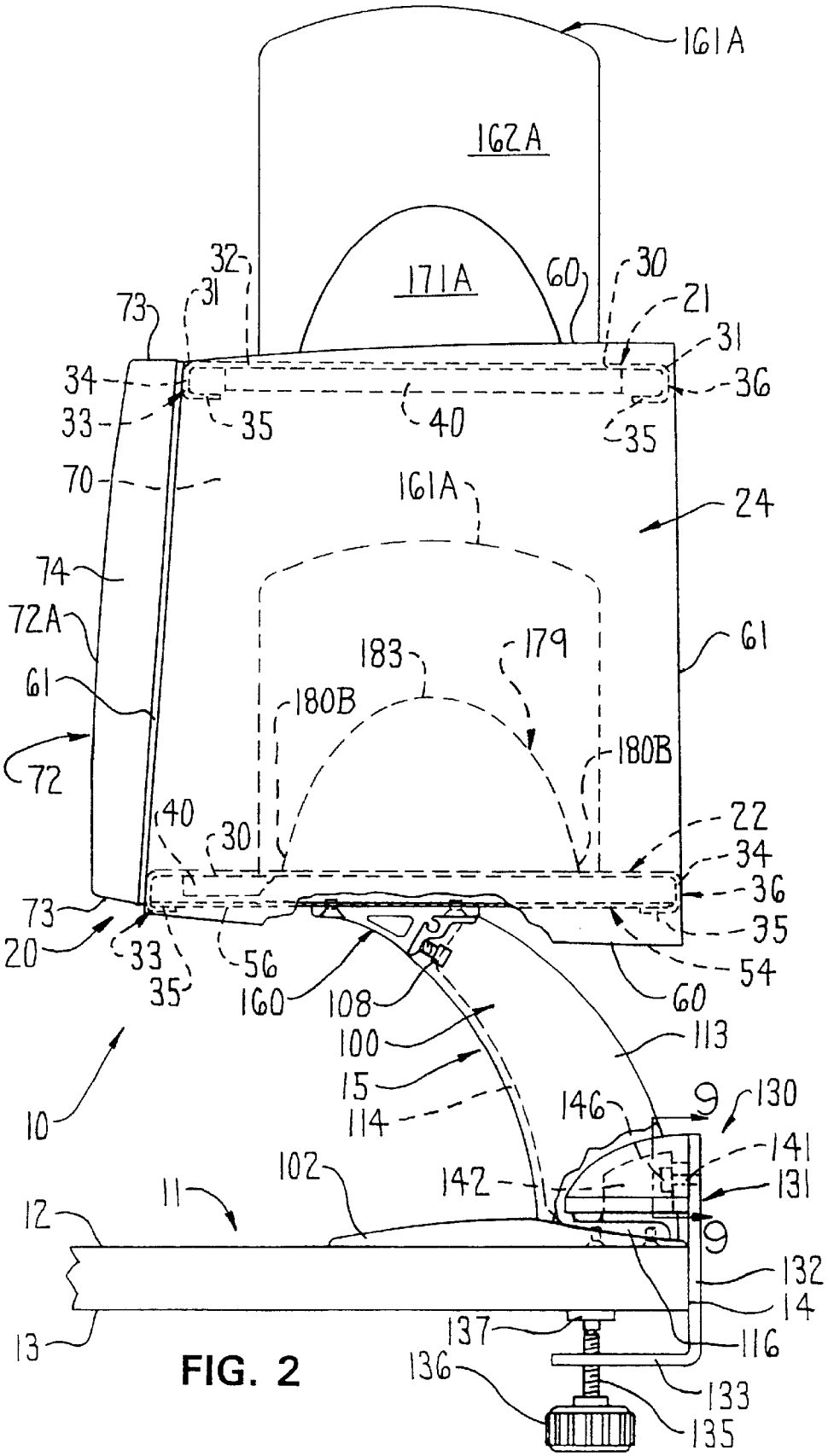
FIG. 2 is a fragmentary elevational end view of the worksurface an storage cabinet of FIG. 1.

Referring to the drawings, and particularly FIGS. 1 and 2, there is illustrated a storage cabinet assembly 10 supported on a generally horizontally oriented worksurface or table 11. The worksurface 11 defines thereon enlarged and generally horizontally oriented upper and lower surfaces 12 and 13 which are opposite one another, with the worksurface terminating in a longitudinally extending edge 14. The edge 14 may define a rear edge of the worksurface 11 which is remote from the side thereof which is normally closest to the worker. The worksurface 11 can be provided with legs (not shown) so as to function as the top of a table, or can be mounted on support arms which project outwardly from a wall which would be positioned closely adjacent the rear edge of the worksurface 11. The storage cabinet assembly 10 includes an enclosed cabinet part 20 mounted on the worksurface 11 by one or more support arms or stanchions 15 which mount on and project upwardly from the worksurface 11 and support the cabinet part 20 in upwardly spaced relation from the worksurface 11 and generally adjacent the edge 14 thereof.

The cabinet part 20 is defined by a plurality of walls or panels, and specifically a top wall or shelf 21, a bottom wall or shelf 22 spaced downwardly from top wall 21, a rear wall 23 extending transversely between top and bottom walls 21 and 22, and a pair of generally parallel side walls 24 which interconnect the top, bottom and rear walls. In the illustrated embodiment, the top, bottom, rear and side walls are constructed of sheet metal, however, other materials may be utilized provided that same are of sufficient rigidity.

Top wall 21 includes a main panel 30 having generally parallel front and rear edges 31 which are joined to one another by a pair of generally parallel side edges 32. As shown in dotted lines in FIG. 2, main panel 30 mounts thereon a frontwardly oriented flange 33 defined by first leg 34 which projects vertically downwardly a short distance from the front edge 31 thereof, and a second leg 35 which projects horizontally inwardly from a lower edge of the first leg 34. Main panel 30 also mounts thereon a rearwardly oriented flange 36 which is a mirror image of front flange 33 and therefore will not be described here. It will be appreciated that while front flange 33 or a similar downwardly depending structure is necessary for locking the cabinet part 20 as discussed below, the rear edge 31 of main panel 30 may simply be formed with a downwardly depending flange only for purposes of attachment to rear wall 23. However the mirror-image configuration of the front and rear flanges 33 and 36 enables easy assembly of the cabinet part 20. A pair of side flanges 40 also depend downwardly from the respective side edges 32 of main panel 30 and terminate short of the respective front and rear flanges 33 and 36. In the illustrated embodiment, the front and rear flanges 33 and 36 of top wall 21 extend along substantially the entire longitudinal extent of the respective front and rear edges 31 of main panel 31, and side flanges 40 extend substantially along the entire extent of the respective side edges 32.

Figure 3:
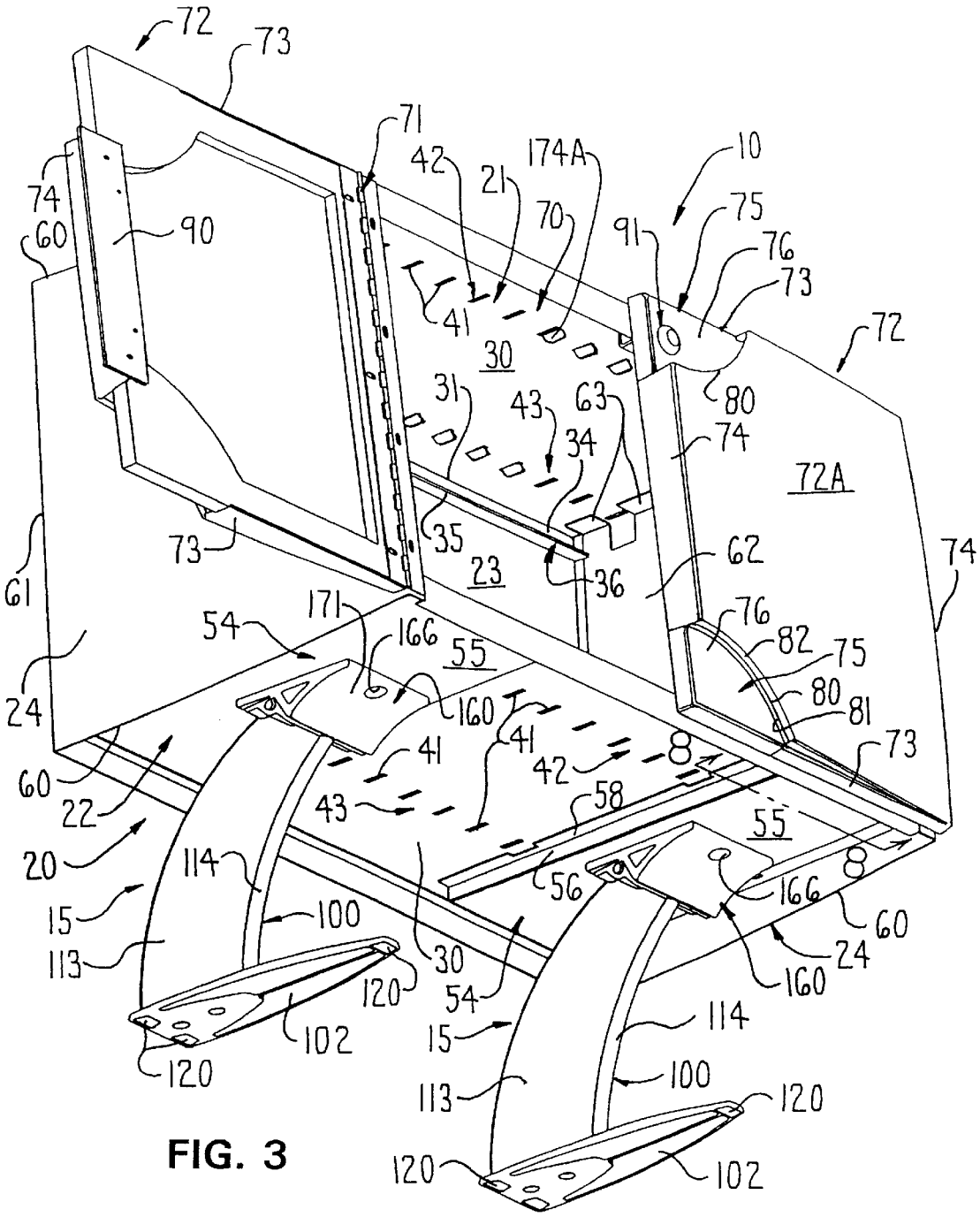
FIG. 3 is an elevational perspective view illustrating the lower side of the storage cabinet and the mounting of the support stanchions thereon, and also showing one door of the storage cabinet in the open position for accessing the interior thereof.

As shown in FIGS. 1 and 3, main panel 30 defines therein a plurality of elongate slots 41, which slots 41 are arranged so as to form parallel elongate front and rear rows 42 and 43 disposed generally parallel to and inwardly of the respective front and rear edges 31 of panel 30 by approximately equal distances. Further, the individual slots 41 are elongated in a front-to-back direction of the main panel 30.

Bottom wall 22 is arranged in generally parallel relation with top wall 21 and is spaced vertically downwardly therefrom. Bottom wall 22 is substantially identical to top wall 21, except that in the illustrated embodiment bottom wall 22 has a slightly greater width dimension as measured in a front-to-back direction of the cabinet part 20. Accordingly, the same reference numbers are utilized for components of bottom wall 22 which are identical or similar to the components of top wall 21.

Figure 8:
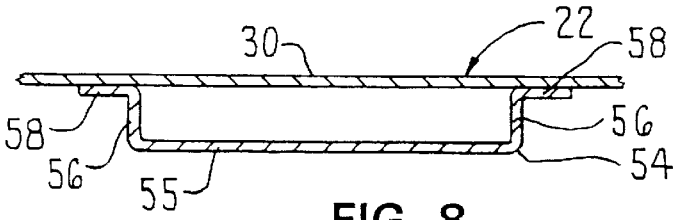
FIG. 8 is a fragmentary cross-sectional view taken generally along line 8—8 in FIG. 3.

With reference to FIGS. 2, 3 and 8, a pair of elongate braces 54 are mounted along bottom wall 22 and extend in a front-to-back direction thereof. Braces 54 are identical to one another and only one of same will be described in detail. Brace 54 includes a planar base wall 55 and a pair of sidewardly spaced side parts 56 which project upwardly in a generally perpendicular manner from the opposite longitudinal edges of base wall 55. A pair of securing flanges 58 project horizontally sidewardly in opposite directions from the upper longitudinal edges of the respective side parts 56. The brace 54 extends transversely across the lower surface of main panel 30 of bottom wall 22, and the base wall 55 at opposite ends thereof is positioned on the respective second legs 35 of the front and rear flanges 33 and 36 of bottom wall 22 as best shown in FIG. 2. The securing flanges 58 can also be fixed to main panel 30 of bottom wall 22 via fasteners or welding.

Turning now to side walls 24, same are defined by top and bottom edges 60 which are joined by generally vertical front and rear side edges 61. As best shown in FIG. 2, the side walls 24 in the illustrated embodiment are generally trapezoidal in shape. More specifically, the top and bottom edges 60 respectively project slightly upwardly and downwardly relative to the horizontal as same project in a front-to-back direction of the cabinet part 20. Further, front side edge 61 projects slightly outwardly as same extends downwardly from the top of the cabinet part 20, and rear side edge 61 is generally parallel to the vertical.

The cabinet part 20 according to one embodiment of the invention may be assembled as follows. Rear wall 23 is fixed to the first legs 34 of the respective rear flanges 36 of top and bottom walls 21 and 22 so as to position same in generally parallel and vertically spaced relation with one another. Side walls 24 are then fixed to the side flanges 40 of the respective top and bottom walls 21 and 22. If desirable or necessary, additional sheet-like braces 62 may be superimposed on the inwardly facing surfaces of side walls 24 (only one of which is shown in FIG. 3) which define a plurality of corner-shaped brackets 63 along the upper and lower edges thereof which are then fastened to the downwardly and upwardly facing surfaces of the respective panels 30 of top and bottom walls 21 and 22. The walls as discussed above may be fastened to one another via welding or other fasteners such as rivets or screws. The assembled cabinet part 20 thus defines an interior storage area 70 which opens sidewardly and frontwardly. Further, a liner may be provided within storage area 70 which covers the interior surfaces of the respective walls and the seams therebetween so as to provide a finished appearance.

In the illustrated embodiment, the top and bottom edges 60 of the respective side walls 24 after connection thereof to the top and bottom walls 21 and 22 extend slightly upwardly beyond the upper surface of top wall 21, as best shown in FIG. 2. More specifically, the top edges 60 of the respective side walls 24 adjacent the front edge 31 of top wall 21 are substantially flush with the upper surface of top wall 21, and top edges 60 angle upwardly as same extend rearwardly toward rear edge 31 of top wall 21. Further, the top edge of rear wall 23 is oriented at essentially the same height as the top edges 60 at the rearmost ends thereof so that a shallow recess is defined at the upper surface of top wall 21. The bottom edges 60 of side walls 24 and the lower edge of rear wall 23 also project downwardly beyond bottom wall 22 in a similar manner.

Figure 6:
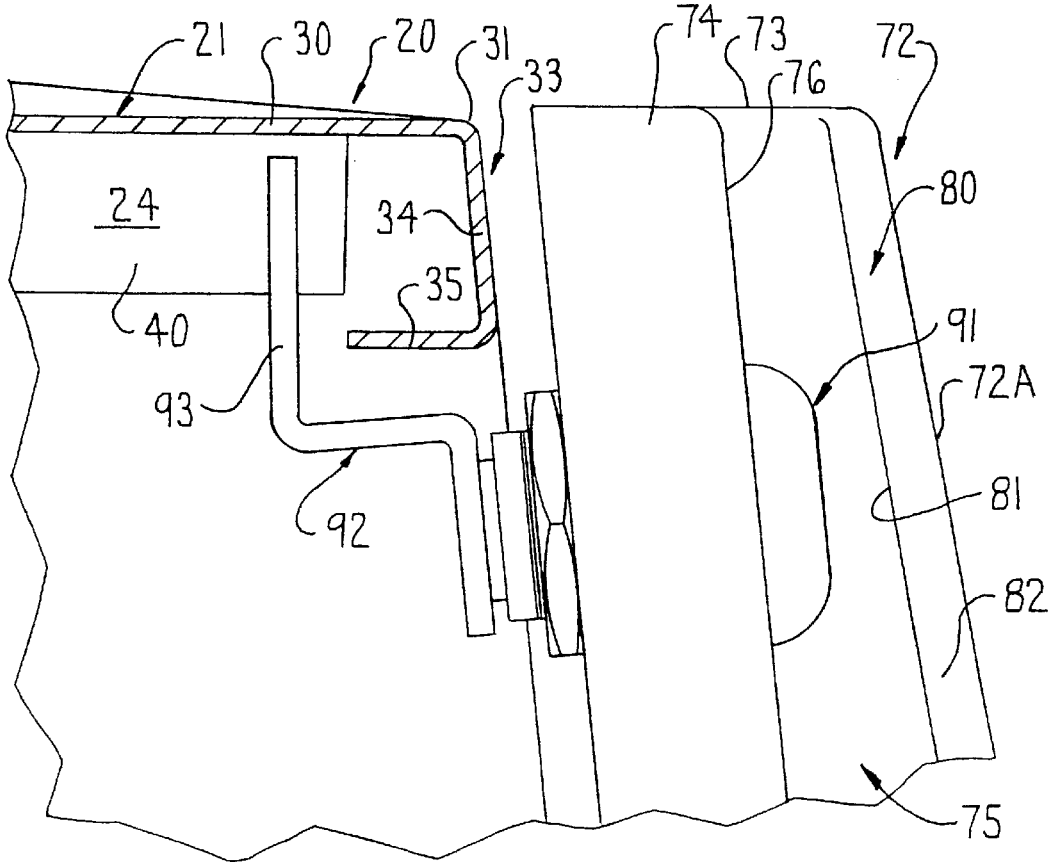
FIG. 6 is a fragmentary cross-sectional view taken generally along 6—6 in FIG. 1.

As shown in FIGS. 1–3, a pair of doors 72 are mounted along the frontwardly oriented side edges 61 of side walls 24 by conventional elongate hinge structures 71. Each door 72 is defines upper and lower substantially horizontal edge portions 73 which are interconnected by a pair of generally parallel and vertically oriented end edge portions 74. Doors 72 each define therein a pair of upper and lower recesses 75 which are horizontally offset inwardly relative to the outermost upright surface 72A of the door 72. The respective recesses 75 are each defined by a flat and generally vertically oriented surface 76 which is bordered by an arcuate shoulder or rim 80. The upper shoulders 80 of the respective doors 72 extend in an arcuate manner between the upper and innermost side edge portions 73 and 74 thereof, and the lower shoulders 80 extend in an arcuate manner between the lower and innermost side edge portions 73 and 74 of the door 72, so that the pair of recesses 75 of each door 72 are respectively disposed at the upper and lower corners located adjacent the free inner edge portions 74 of the door 72 and are vertically spaced from one another. Shoulder 80 defines therein an arcuate channel 81 which projects inwardly into the material of the door 72 in a direction generally parallel to surface 76 so as to effectively define a lip 82 which is easily grippable by the fingers for opening or closing the door 72 (FIGS. 3 and 6). As shown in FIG. 1, when the doors 72 are in the closed position, the upper and lower recesses 75 of the respective doors 72 are disposed closely adjacent one another and together define upper and lower semi-circular recesses. More specifically, the upper adjacent recesses 75 of the respective doors 72 together define the lower half of a circle, and the lower adjacent recesses 75 together define the upper half of a circle.

Referring to FIGS. 1, 3 and 6, the doors 72 are provided with a locking arrangement which may be utilized when same are in the closed position so as to prevent access to the interior storage area 70. One type of locking arrangement which may be utilized according to the invention includes a lock plate 90 which is fixed to an inner surface of one door 72 generally adjacent the inner free side edge portion 74 thereof so as to project horizontally beyond the outer terminal edge thereof. The opposite door 72 is provided with a conventional lock, such as a key lock 91 which is provided with a cam member 92 which rotates along with the locking mechanism. Cam member 92 in the illustrated embodiment includes an upper flange 93 which when turned to the uppermost position is vertically oriented and projects upwardly beyond the second leg 35 of front flange 33 of top wall 21. To lock the cabinet part 20, door 72 including the lock plate 90 is closed first, and the opposite door 72 is then closed over plate 90. The locking mechanism is then turned to the lock position (as shown in FIG. 6) with a key for example, which moves the flange 93 into the position behind second leg 35 of front flange 33 to block any outwardly opening movement of the door 72.

The doors 72 in the illustrated embodiment may be molded parts and may be constructed of plastic, such as ABS. Further, except for the locking arrangement, the doors 72 are identical to one another and may be formed using the same mold and then later equipped with the above-discussed lock plate 90 and lock 91 as appropriate. It will be appreciated that the above locking arrangement is only one example of a type of locking arrangement which may be utilized with the present invention, and other locking arrangements are within the scope thereof.

Figure 5:
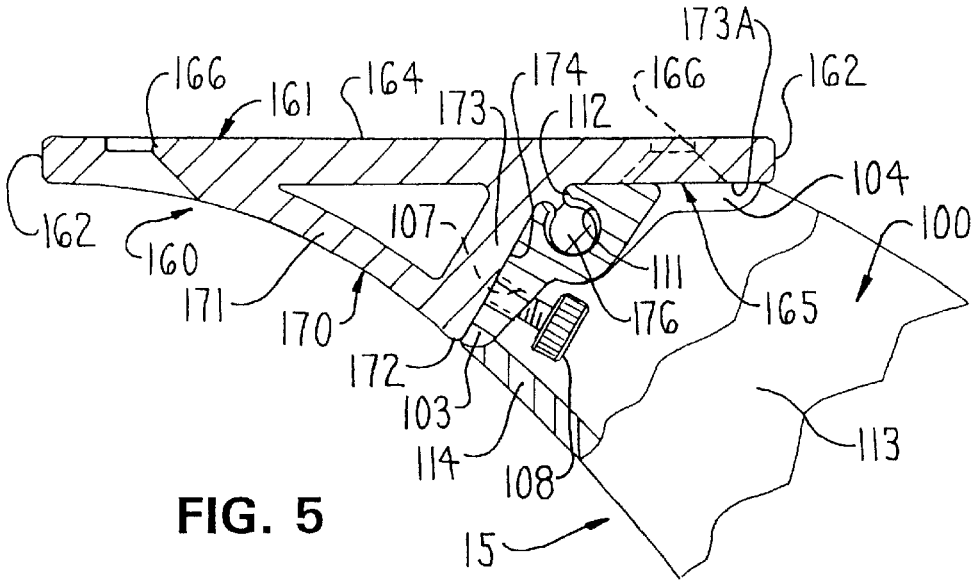
FIG. 5 is a fragmentary cross-sectional view taken generally a on 5—5 in FIG. 4.

Turning now to the support arms or stanchions 15, same are identical to one another and only one will be described herein. Stanchion 15 includes a main tower or body part 100 having a lower end which mounts thereon an elongate foot 102 and an upper end which terminates in front and rear flat support plates 103 and 104. Support plates 103 and 104 are angled with respect to one another and define flat upper bearing surfaces thereon. In the illustrated embodiment, the support plates 103 and 104 are oriented at an angle of about 60° relative to one another. Front support plate 103 defines therein a pair of threaded holes 107 (only one of which is shown in FIG. 5) which respectively receive therein set screws 108. Body part 100 additionally defines therein a longitudinally extending and generally cylindrical channel or slot 111 which opens upwardly at an elongate and narrow access opening 112 defined by the opposed inner longitudinal edges of the front and rear support plates 103 and 104. Slot 111 extends in generally parallel relation with the edge 14 of the worksurface. Slot 111 additionally opens sidewardly at opposite ends thereof. In the illustrated embodiment, slot 111 has a generally circular cross-section.

The body part 100 has a generally arcuate profile when viewed from the side thereof so as to project upwardly and forwardly from the edge 14 of the worksurface 11 toward the opposite edge thereof. Body part 100 is further defined by a pair of upright side walls 113 joined at the forward edges thereof by a short web 114 and spaced apart from one another at the rear edges thereof. The side walls 113 and the web 114 thus together define a rearwardly opening, and generally triangular recess 115. A bottom wall 116 is fixed to the lower ends of side walls 113 with the rear edge 117 thereof being recessed forwardly of the aligned rear edges of the side walls 113 and with the top surface 118 of the wall 116 being generally parallel with the upper surface 12 of the worksurface 11. The bottom wall 116 defines therein one or more fastener receiving openings which open through the lower surface of bottom wall 116. Stanchion 15 is similar to the stanchion disclosed in copending U.S. patent application Ser. No. 09/304,162, which is hereby incorporated by reference in its entirety.

Figures 4, 9:
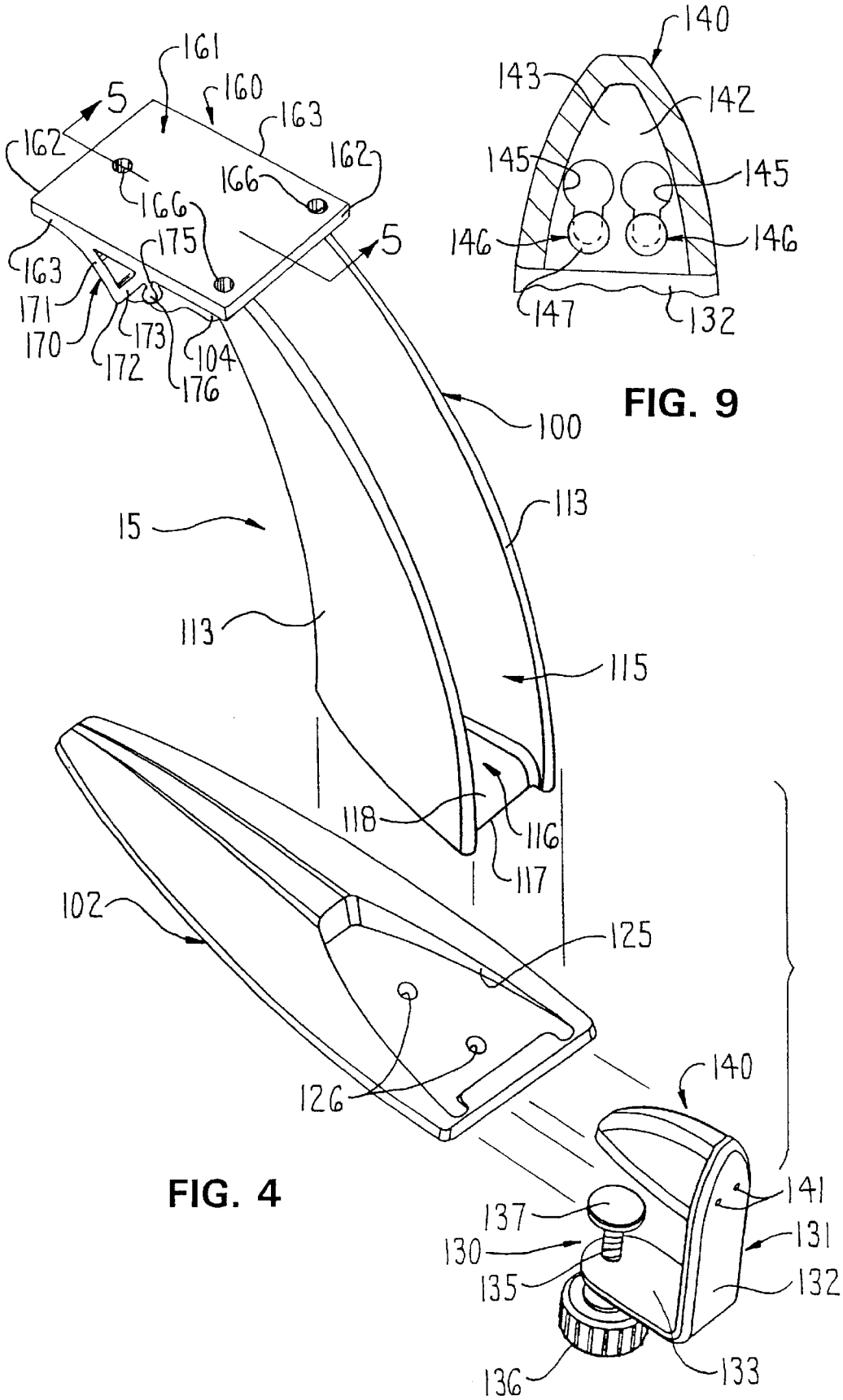
FIG. 4 is an exploded perspective view of a support stanchion and bracket mounted on the upper end thereof, and the mounting arrangement for removably securing the stanchion to the worksurface.
FIG. 9 is an enlarged fragmentary cross-sectional view taken generally along line 9—9 in FIG. 2.

The foot 102 is fixed to the lower end of the stanchion 15 and bears upon the upper surface 12 of the worksurface 11. More specifically, as shown in FIG. 4, the foot 102 defines therein a recess 125 having a shape which matches the outer profile of the lower end of stanchion 15 and receives same therein. Foot 102 defines therein at least one or more openings 126 which are aligned with the openings of bottom wall 116 and receive fasteners therein to fix foot 102 to stanchion 15. In the assembled state, the foot 102 extends forwardly of the support arm 15 with its forwardmost point projecting horizontally beyond the forwardmost edges of the respective support plates 103 and 104. The foot 102 rests on the upper surface 12 of the worksurface 11 and may have non-marring feet 120 along the bottom surface thereof to prevent scuffing or damage to worksurface 11.

A mounting bracket 130 is provided to removably attach the stanchion 1s to the worksurface 11. Bracket 130 includes a J-shaped member 131 defined by a vertically oriented flat upper leg 132 and a flat lower leg 133 which projects horizontally from a lower end of upper leg 132. Upper leg 132 overlies the edge 14 of worksurface 11, and lower leg 133 projects partially under the worksurface 11. Lower leg 133 mounts thereon a manually adjustable fastening member 135, the latter being threadingly engaged with the leg 133 and at its lower end has an enlarged knob 136 thereon. The upper end of fastening member 135 mounts thereon a wobble contact or bearing plate 137 for engagement with the lower surface 13 of worksurface 11.

The uppermost end of upper leg 132 removably mounts thereon a forwardly projecting arm 140 having an outer profile which is similar to the profile of the rearwardly opening recess 115 of stanchion 15. As shown in FIG. 4, the upper end of leg 132 defines therein a pair of sidewardly spaced threaded apertures 141. Arm 140 has a generally hollow interior 142 defined in part by a rear wall 143 (FIG. 9) which is generally vertically oriented and disposed in juxtaposed relation with the upper end of leg 132. With reference to FIG. 9, rear wall 143 defines therein a pair of keyhole-shaped slots 145 which respectively receive therein a pair of threaded fasteners 146 with enlarged heads 147 which are slightly smaller in diameter than the upper circular-shaped portions of slots 145 to permit of fasteners 146 therefrom.

The cabinet part 20 is mounted on the respective stanchions 15 by a pair of mounting members 160. Mounting members 160 are identical to one another and only one of which will be described in detail. Mounting member 160 includes a generally rectangular and flat upper plate 161. Plate 161 defines front and rear generally parallel edges 162, a pair of generally parallel side edges 163 which extend between and interconnect front and rear edges 162, and oppositely facing upper and lower surfaces 164 and 165. A plurality, and here three, of mounting holes 166 extend through upper plate 161, two of which are disposed in a spaced apart manner from one another adjacent rear edge 162, and a third of which is disposed generally centrally along front edge 162. As shown in FIG. 5, mounting member 160 includes a generally triangular shaped base part 170 which has an angled front wall 171 which projects downwardly as same projects rearwardly from front edge 162 and terminates at a lower longitudinal edge 172. Base part 170 additionally includes an inclined rear wall 173 which is adjoined to edge 172 at one end thereof and projects upwardly as same projects rearwardly until same adjoins lower surface 165. Rear wall 173 thus defines an inclined rearwardly facing bearing surface 174.

At the junction or apex of surface 174 and lower surface 165 of plate 161, a rib 175 projects generally downwardly from this junction and extends along the entire extent of lower surface 165 in generally parallel relation with front and rear edges 162. This rib 175 is of narrow width and projects outwardly only a limited extent, and at its outer end is joined to an elongate mounting rod 176 which is of increased cross-sectional size as compared to rib 175, and extends along the entire surface 165. The mounting rod 176 in the illustrated embodiment is generally cylindrical in cross-section. Rod 176 as well as the terminal upper edge of rear wall 173 are positioned horizontally inwardly of rear edge 162 of plate 161 and a downwardly facing and generally horizontal bearing surface 173A is defined at the lower side of plate 161 which forms part of lower surface 165.

In the illustrated embodiment, stanchion 15, foot 102, bracket 130 and mounting member 160 are constructed of a rigid material, such as metal, and may be die-cast aluminum parts.

To mount the cabinet part 20 on the worksurface 11, a pair of mounting members 160 are first installed on the upper ends of the respective stanchions 15 as follows. The mounting member 160 is positioned with the base part 170 facing downwardly and the bearing surface 174 facing rearwardly. The mounting rod 176 is then sidewardly inserted into the channel 111 of stanchion 15 so that the bearing surfaces 174 and 173A are superimposed on the respective front and rear plates 103 and 104 of stanchion 15. The set screws 108 are then tightened from beneath front plate 103 so that the ends of same bear against the bearing surface 174 to lock mounting member 160 at the upper end of stanchion 15. With the members 160 mounted atop the respective stanchions 15, members 160 can then be fixed to the respective braces 54 attached to bottom wall 22 at approximately midway therealong, for example by turning the cabinet part 20 on its side. Fasteners such as screws are inserted into the respective holes 166 of members 160 and into base wall 55 with the front walls 171 thereof facing forwardly. The cabinet part 20 can then be turned upright again and the respective stanchions 15 attached to the edge 14 of the worksurface utilizing mounting brackets 130. More specifically, upper leg 132 with the pair of fasteners 146 mounted thereon (i.e. with the enlarged heads 147 thereof in forwardly spaced relation from the leg 132) is positioned along rear edge 13 with the lower leg 133 projecting under worksurface 11. The arm 140 (having been previously separated from upper leg 132) is then positioned adjacent the upper surface 12 of the worksurface 11 with the rear wall 143 thereof facing leg 132, and the arm 140 is then moved rearwardly so as to insert the enlarged heads 147 into the upper circular portions of the respective slots 145 so that same project into the hollow interior 143 of arm 140. The cabinet part 20 with the attached stanchions 15 (and the associated feet 102) is then moved toward the respective arms 140 with the recesses 115 of stanchions 15 facing rearwardly to insert the forwardly projecting noses of arms 140 thereinto so that same are positioned above the respective bottom walls 116. With the stanchions 15 and mounting brackets 130 positioned in this manner, the knobs 136 are then rotated causing fastening members 135 and the respective wobble plates 137 to advance upwardly toward lower surface 13 of worksurface 11. Once wobble plates 137 engage the lower surface 13, continued rotation of the fastening members 135 will cause the respective arms 140 to bear down on the bottom walls 116 of stanchions 15 and apply a clamping force thereto and clamp bottom wall 116 and foot 102 between the arm 140 and worksurface 11.

Alternatively, the arm 140 can be pre-assembled onto the upper leg 132 and both components can then be moved sidewardly over an edge 14 of the worksurface 11, if space permits.

The storage cabinet can be removed from the worksurface 11 essentially by reversing the above-described mounting steps. Further, it will be appreciated that other assembly methods may be utilized in accordance with the present invention, and the above is presented only as an example.

As shown in FIG. 2, the stanchions 15 position the storage cabinet so that the rear wall 23 of same is generally vertically aligned with the edge 14 of the worksurface 11, and so that the bottom wall 22 thereof is spaced upwardly from upper surface 12. Further, the small thickness of the upper leg 132 of mounting member 130 as measured in the front-to-back direction of the arrangement and the forward projection of the stanchion 15 permits the storage cabinet to be mounted on a worksurface having an edge which lies closely adjacent a wall, or with a worksurface which is attached to an upright panel of a conventional space-dividing panel system. In addition, the mounting arrangements 130 associated with stanchions 15 enable mounting of same from above and below the worksurface 11, which is particularly advantageous since the space between an edge 14 (and specifically the rear edge) and the associated wall or panel is often limited (and can typically be one inch or less), and this thus avoids having to move the worksurface away from the adjacent wall, or having to disconnect the worksurface from a panel.

The top and bottom walls 21 and 22 respectively define upper and lower substantially horizontally oriented shelves or support surfaces. These shelves may be utilized for storage and/or display of work related items, such as documents, writing utensils, or other items which can conveniently be kept off of the worksurface 11 within or on top of the cabinet 20 so as to make available additional space on worksurface 11.

Figure 7:
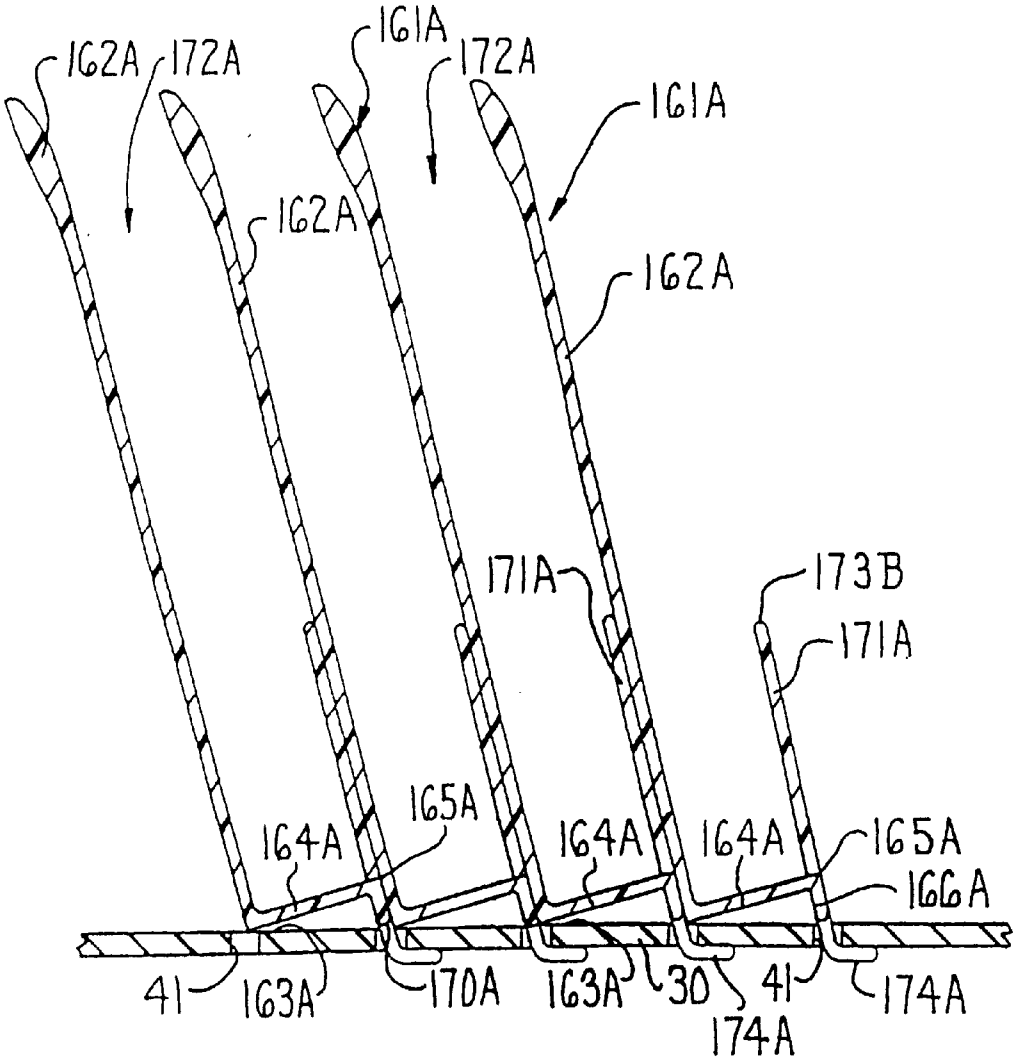
FIG. 7 is an elevational cross-sectional view illustrating the construction of a first embodiment of the divider elements and the mounting thereof to the top or bottom wall or shelf of the storage cabinet.

Further, the rows 42 and 43 of slots defined in the top and bottom shelves 21 and 22 may be utilized to mount upright space-dividing elements thereon for storage and organization of papers or documents on either of the shelves. In this regard, FIGS. 1, 2, 7 and 10 illustrate two types of space-dividing elements which may be used in conjunction with the present invention. Referring to FIG. 7, a plurality of slotted divider elements 161A are illustrated, which when viewed in cross-section are of a generally upwardly-opening U-shape configuration and include a main upright rear or support wall 162A which at its lower end is rigidly joined at a corner 163A to the rear of a base or bottom wall 164A This bottom wall 164A projects forwardly in substantially perpendicular relationship from the rear wall 162A through a relatively small distance, and at its forward edge is joined through a corner 165A to a downwardly projecting front flange 166A. The latter projects substantially perpendicularly downwardly from the bottom wall 164A so as to extend substantially in parallel relationship to the rear wall 162A. This front flange 166A is of short vertical extent and terminates in a lower free edge 170A which is adapted to bearingly engage the upper surface of the main panel 30 of top or bottom wall 21, 22 when the slotted divider element 161A is mounted thereon.

Each slotted divider element 161A also has a front wall 171A which projects upwardly from the corner 165A substantially coplanar with the front flange 166A. This front wall 171A extends upwardly in sidewardly spaced but substantially parallel relationship with the rear wall 162A and thus, in cooperation with the bottom wall 164A, defines a channel-like storage slot 172A which opens upwardly and outwardly at both ends.

The front wall 171A, has a height which, as determined by the upper edge 173A, is significantly less than, and in fact is typically about one-half of the height of the rear wall 162A the height of which is determined by its upper edge 173B. The front wall 171A in the illustrated embodiment also has a generally rounded or arcuate peripheral edge so that it resembles approximately one-half of a cylinder or ellipse, and has a width which is significantly smaller than the width of the respective rear wall 162A, thereby providing improved aesthetics and accessibility with respect to at least the frontmost slotted divider element 161A.

To assist in stable attachment of the divider elements 161A to the panel 30 of the top or bottom wall 21, 22, the front flange 166 of the divider element 161A has a pair of sidewardly-spaced tabs or hooks 174A. cantilevered downwardly from the free edge 170A, which tabs or hooks 174A project downwardly through a transversely spaced pair of slots 41 formed in the panel 30 of top or bottom wall 21, 22. The hooks 174A are preferably J- or L-shaped so that the lower horizontally projecting legs thereof project transversely under the panel 30 to provide stability to the slotted divider elements 161A by resisting tipping thereof.

The slotted divider elements 161 can be individually positioned on the respective panel 30 by orienting the divider elements so that the front and rear walls extend generally vertically to facilitate insertion of the J-hooks 174A through the slots 41 until the free edge of front flange 166A abuts the panel 30. The slotted divider element is then vertically rotated through a small angle until the corner 163A abuts the top surface of the panel 30, which in turn causes the J-hooks to engage under the panel 30. A plurality of divider elements 161A can be sequentially mounted in side-by-side relationship on the top or bottom wall 21, 22. Further, due to the symmetry of the divider elements, they can be horizontally rotated 180° for mounting on the panel 30 so as to be inclined either rightwardly or leftwardly depending upon the preferred orientation of the worker.

With the divider elements 161A mounted on the top or bottom wall 21, 22, substantially as illustrated by FIG. 7, the plurality of storage slots 172A are readily accessible either from above or from the front of the cabinet 20, and thus various documents or objects can be conveniently stored within the storage slots 172A. The upward projection of side walls 24 and rear wall 23 beyond the upper surface of panel 30 function as stop surfaces for documents inserted into the storage slots 172.

When the slotted divider elements 161A are mounted on the horizontally oriented walls 21, 22, the front and rear walls 171A and 162A of the divider elements are disposed so as to extend at a small angle or incline relative to the vertical, and likewise the bottom wall 164A of the divider element also extends at a small incline relative to the horizontal, whereupon documents disposed in a respective storage slot will naturally lean against and be supported by the respective back wall 162A.

The slotted divider element 161A in its entirety is preferably formed from a generally thin sheet-like material so as to have a substantially uniform thickness throughout. In a preferred embodiment the slotted divider element 161A is formed in one piece of a plastics material, such as ABS, PP, or HDPE, such as by injection molding. While the latter is preferred, it will be recognized that other forming and manufacturing techniques and materials can be utilized.

The above-discussed divider element 161A is described in detail in copending U.S. patent application Ser. No. 09/304 161 which is hereby incorporated by reference in its entirety herein.

Figure 10:
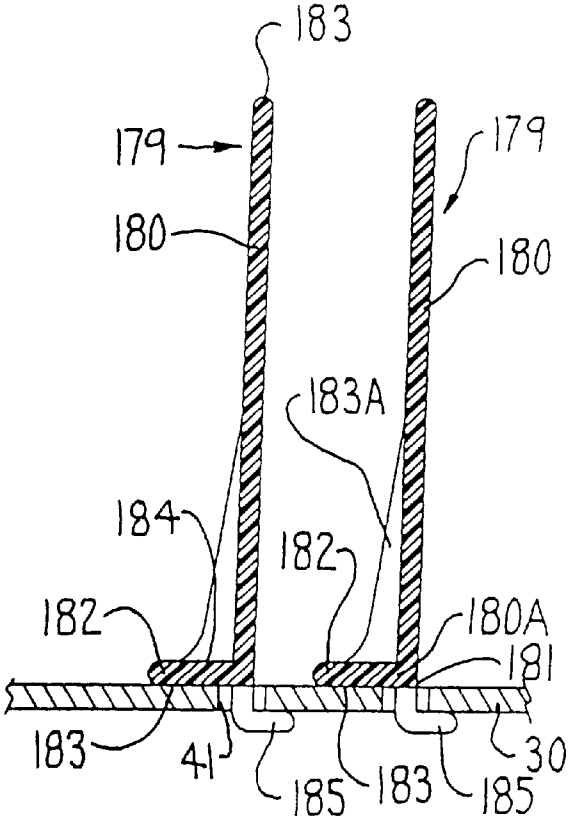
FIG. 10 is an elevational cross-sectional view illustrating the construction of a second embodiment of the divider elements and the mounting thereof on the top or bottom shelf of the storage cabinet.

An additional type of divider element 179 which may be utilized in accordance with the present invention is illustrated in FIGS. 1, 2 and 10. Divider element 179 includes an upright wall or panel 180 which at its lower edge 180A is rigidly joined at a corner 181 to the front of a rear support wall 182. The upright panel 180 in the illustrated embodiment defines a convex or rounded terminal upper edge 183. The rear support wall 182 projects rearwardly in substantially perpendicular relationship from the upright panel 180 through a relatively small horizontal distance and defines a lower substantially planar surface 183 which is adapted to bearingly engage the upper surface of main panel 30 of top or bottom wall 21, 22 when the divider element 180 is mounted thereon. The rear support wall 182 may extend longitudinally along substantially the entire lower edge 180A of upright panel 180, or alternatively may be located generally centrally along the lower edge 180A and terminate short of the lower terminal side edges 180B of panel 180. As shown in FIG. 10, one or more webs 183A may extend vertically and adjoin the rear surface of upright panel 180 and the upper surface 184 of rear support wall 182 for reinforcement purposes.

To assist in the stable attachment of the divider element 180 to the panel 30 of the top or bottom wall 21, 22, a pair of sidewardly-spaced tabs or hooks 185 are cantilevered downwardly from the lower edge 180A of upright panel 180, which tabs 185 project downwardly through a transversely spaced pair of slots 41 of the respective front and rear slot rows 42 and 43. The tabs 185 are substantially L-shaped so that the lower horizontally projecting legs thereof project under the panel 30 to stabilize the divider element 179.

The divider elements 179 can be individually positioned on the panel 30 by orienting the upright panel 180 so that the same is generally horizontally oriented relative to panel 30 with the lower horizontal legs of the respective tabs 185 projecting generally downwardly. These legs are then inserted into the respective slots 41 and the divider element 179 is then rotated so that upright panel 180 is generally vertically oriented which causes the lower surface 183 of rear support wall 182 to engage the upper surface of the panel 30 and the lower horizontal legs of the respective tabs 185 to engage the lower surface of panel 30.

Divider elements 179 may also be formed as one piece of a plastics material, such as ABS, PP, or HDPE, for example by injection molding.

It will be appreciated that while the above-described storage cabinet is depicted as an enclosed structure herein, the bottom wall 22 thereof may simply be provided (i.e. without top wall 21, side walls 24, rear wall 23 and doors 72) and used as a single shelf supportable with one or more stanchions 15 in upwardly spaced relation from the worksurface 11 as discussed above. Further, this type of shelf arrangement may also be utilized directly adjacent the storage cabinet assembly 10 described above. In this regard, the single shelf arrangement or platform preferably has a smaller width dimension as measured in a front-to-back direction so that the door 72 of the adjacent assembly 10 located closest to the shelf can be completely opened so as to lie across the frontmost edge of the shelf.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A storage arrangement comprising:

a worksurface having a generally horizontally oriented upper surface and at least one edge;

a storage unit including a generally horizontally oriented load-bearing panel defining a storage area thereabove and having front and rear edges and a pair of end edges which extend transversely between said front and rear edges;

a pair of generally upright arms each having a lower end supported on said worksurface adjacent said edge thereof and an upper end defining a connector element thereon; and a pair of discrete mounting elements fixed to said panel at a lower side thereof by fasteners which extend through the respective mounting elements and into said panel, said mounting elements being disposed in a spaced-apart manner with one another and respectively interconnecting said storage unit to said upper ends of said arms, each said mounting element and the corresponding said connector element together defining a releasable connection including a projection which is cantilevered outwardly from one of said elements and a channel defined in the other said element, said channel opening sidewardly towards at least one of said end edges of said panel and slidably receiving therein said projection to releasably mount said storage unit on said arms.

2. The storage arrangement of claim 1 wherein said mounting elements are disposed entirely beneath said panel so as not to project horizontally beyond said panel.

3. The storage arrangement of claim 1 wherein each said channel opens sidewardly towards both of said end edges such that said projection is insertable sidewardly into said channel through either open end thereof.

4. The storage arrangement of claim 3 wherein said projections are cantilevered downwardly from the respective mounting elements and said channels are defined in the respective connector elements on said upper ends of said arms.

5. The storage arrangement of claim 1 further including mounting arrangements for respectively securing said arms to said worksurface, each said mounting arrangement including an upright upper part positioned along said edge of said worksurface and a nose which projects sidewardly from said upper part and into a rearwardly opening recess defined in said arm, and a lower part connected to said upper part and which projects partially under said worksurface and clampingly engages said edge thereof.

6. The storage arrangement of claim 1 wherein each said mounting element includes an upper plate-shaped part which defines an upper surface thereon disposed in supportive engagement with said panel and a pair of surfaces defined adjacent a lower side of said plate-shaped part which are angled relative to one another, one of said surfaces facing generally downwardly and the other said surface facing generally rearwardly, each said connector element defining thereon a pair of plates which are angled relative to one another and disposed in direct supportive engagement with the respective said surfaces of the respective said mounting element.

7. The storage arrangement of claim 6 wherein said channels are elongated and extend in a direction which is generally parallel to said edge of said worksurface and along a junction between said plates of the respective connector element, and said projections comprise elongated rods fixed to the respective mounting element and extending along a junction between said surfaces thereof.

8. The storage arrangement of claim 7 wherein an angle defined between said surfaces of the respective plate-shaped parts is substantially the same as an angle defined between said plates of the respective connector elements, said angles being greater than 90 degrees.

9. A storage arrangement mountable on a worksurface having generally horizontally enlarged upper and lower oppositely facing surfaces and at least one edge, said arrangement comprising:

a cabinet having upper and lower generally horizontal walls, a rear wall which is generally vertical and extends transversely between said upper and lower walls so that same are vertically spaced from one another, and a pair of upright end walls extending between and interconnecting said upper, lower and rear walls to provide said cabinet with a generally hollow and sidewardly-opening interior storage space, said lower wall mounting thereon an elongate channel member which extends transversely between front and rear longitudinal edges of said lower wall, said channel member being defined by an elongate base wall which is spaced vertically downwardly from a bottom surface of said lower wall by a pair of upright side walls which adjoin at upper ends thereof to respective horizontal flanges attached to said bottom surface, said base wall removably mounting thereon a mounting element at a generally central location therealong between said front and rear edges of said lower wall, and a door structure mounted to said cabinet and swingably movable between a closed position so as to close off said storage space and an open position to provide access thereto;

a support arm connected to the worksurface adjacent the edge thereof for stationarily positioning said cabinet above the worksurface and generally adjacent the edge thereof, said cabinet being supported in its entirety on said support arm so as to be free of direct supportive engagement with the worksurface, said support arm having an upper end configured to cooperatively and releasably engage with said mounting element of said base wall and a lower end which bears upon the upper surface of the worksurface, said support arm defining a sidewardly opening recess therein; and a mounting arrangement for securing said support arm to the worksurface, said mounting arrangement including an upper part positioned along the edge of the worksurface and having a nose which projects into said recess of said support arm and bears against a bottom wall thereof, and a lower part connected to said upper part and which projects partially under the worksurface, said lower part including a manually adjustable fastening element which is actuable to exert a downwardly directed force on said upper part to clamp said nose against said bottom wall and fix said support arm to the worksurface.

10. The arrangement of claim 9 wherein said door structure includes first and second doors having outer edge portions which are hingedly connected to respective forwardmost ends of said end walls so as to pivot about respective vertical axes, each said door having a generally rectangular shape and defining therein a pair of recesses respectively located at upper and lower corners of said door adjacent an inner free edge portion thereof.

11. The arrangement of claim 9 wherein a pair of said support arms are provided which cooperatively engage with a pair of said mounting elements each provided on a said base wall of a respective channel member, said support arms being positioned adjacent opposite transverse edges of said lower wall, said lower ends of said support arms being positioned closely adjacent, but not projecting horizontally beyond, the edge of the worksurface, and each said support arm having a configuration which projects forwardly as same projects upwardly from said lower end to said upper end thereof.

12. The arrangement of claim 9 wherein said upper and lower walls define a plurality of slots therein for mounting a plurality of generally upright divider elements thereon, said divider elements each including at least one projecting hook structure which engages within a respective one of said slots to releasably secure said divider element to one of said walls, said divider elements being positionable in side-by-side spaced relation with one another so as to define at least one sidewardly and upwardly opening storage slot therebetween for accommodating documents or other materials, and said divider elements when mounted on said lower wall being disposed within said storage space.

13. The arrangement of claim 9 wherein one of said mounting element and said upper end of said support arm includes a projection which is cantilevered outwardly therefrom and engaged within a channel defined in the other of said mounting element and said upper end to releasably mount said cabinet to said support arm.

14. The arrangement of claim 13 wherein said channel opens sidewardly towards each of said end panels of said cabinet such that said projection is sidewardly insertable into said channel from either open end thereof, said mounting element having an upper plate-like member which is fixed to said lower panel by at least one fastener, and a set screw extends through a portion of said upper end of said support arm and bears against said mounting element to securely but releasably fasten said mounting element to said support arm.

15. The arrangement of claim 14 wherein said projection is cantilevered downwardly from a lower side of said plate-like member and said channel is defined in said upper end of said support arm.

16. The arrangement of claim 9 wherein a pair of said channel members are provided and extend transversely between said front and rear longitudinal edges of said lower wall in laterally-spaced and generally parallel relation with one another, and a pair of said support arms are provided and connected to the worksurface which cooperatively engage with a pair of said mounting elements each provided on a said base wall of a respective channel member.

* * * * *